US009371714B2

(12) United States Patent
Tubel et al.

(10) Patent No.: US 9,371,714 B2
(45) **Date of Patent: *Jun. 21, 2016**

(54) DOWNHOLE SMART CONTROL SYSTEM

(75) Inventors: Paulo Tubel, The Woodlands, TX (US); Rogelio Cantu, The Woodlands, TX (US); Jorge Laurent, The Woodlands, TX (US); James Kendall Warren, Conroe, TX (US); Sagar Shinde, Houston, TX (US); Amanda Tubel, The Woodlands, TX (US)

(73) Assignee: Tubel Energy LLC, The Woodlands, TX (US)

( * ) Notice: Subject to any disclaimer, the term of this patent is extended or adjusted under 35 U.S.C. 154(b) by 943 days.

This patent is subject to a terminal disclaimer.

(21) Appl. No.: 13/186,821

(22) Filed: Jul. 20, 2011

(65) Prior Publication Data

US 2013/0020065 A1 Jan. 24, 2013

(51) Int. Cl.
*E21B 33/12* (2006.01)
*E21B 34/06* (2006.01)

(52) U.S. Cl.
CPC ..... *E21B 34/066* (2013.01)

(58) Field of Classification Search
CPC ..... E21B 34/066
USPC ..... 166/177.5, 332.1, 332.8, 334.4, 373, 166/386
See application file for complete search history.

(56) References Cited

U.S. PATENT DOCUMENTS

| | | | | |
|---|---|---|---|---|
| 6,310,559 | B1 * | 10/2001 | Laborde et al. | 340/853.2 |
| 6,328,112 | B1 * | 12/2001 | Malone | 166/386 |
| 7,503,398 | B2 * | 3/2009 | LoGiudice et al. | 166/386 |
| 2009/0065194 | A1 * | 3/2009 | Frazier | 166/168 |

* cited by examiner

*Primary Examiner* — Taras P Bemko
(74) *Attorney, Agent, or Firm* — Maze IP Law PC

(57) ABSTRACT

A wellbore insert comprises a housing that further comprises an inner annulus and one or more ports dimensioned and configured to provide a fluid pathway between the inner annulus of the housing and the outer surface of the housing. A selectively movable port seal, operable via a port seal mover, is dimensioned and configured to selectively occlude or open these ports. A movable plug, controlled by a plug mover, operates within the housing to selectively permit or occlude fluid flow within the housing. A power supply and a detector are typically present within the housing. An individually addressable electronic control module is operable to effect a change in the position of the selectively movable port seal and/or the movable plug. The wellbore insert can be used for downhole operations such as frac operations.

19 Claims, 3 Drawing Sheets

DOWNHOLE SMART CONTROL SYSTEM

BACKGROUND

There is a significant activity in the oilfield today to perform operations such as frac work in shales or deepwater to provide a path for hydrocarbons stored in the formations to be produced. Horizontal wells are drilled and divided into multiple zones within the horizontal and deviated sections of the well. Each zone is frac'ed individually to allow for the production of hydrocarbon. Each zone may further comprise a packer used to isolate and create multiple zones downhole and a sliding sleeve.

Normally, a sliding sleeve controls the flow of fluid from the inside of the production pipe into the reservoir or from the reservoir to the inside of the production pipe. For frac applications, the sleeve is adapted with a seat which is attached to the inner sleeve. The seat allows for a ball pumped from the surface into the well to be seated on the seat, sealing the well below the ball. The seats may have multiple diameters allowing for multiple diameter balls to be deployed in a well. A large seat will allow a smaller ball to pass by the seat and reach a seat at a lower zone in the well.

Once the well is frac'ed the seats and the balls in the well are milled out to allow production to occur. The costs associated with pumping balls in wells and the cost and time associated with milling the balls and seats are quite high. Also, there is a limit to the number of balls and seats that can be used due to the size of the balls and the potential that a small ball may not go through a seat. This limitation reduces the options related to the number of sliding sleeves that can be deployed in a well hence limiting the number of production zones that can be created in a well.

In addition, there cannot be any control of the hydrocarbon flow in the laterals because no hydraulic lines or electrical lines can be deployed from the main bore into the laterals so that all control of each lateral has to be done from far away in the main bore.

FIGURES

The figures supplied herein disclose various embodiments of the claimed invention.

DESCRIPTION OF EMBODIMENTS OF THE INVENTION

An electromechanical downhole smart control system such as that described below may be used to replace a ball and seat in a sliding sleeve in a wellbore to control the a wellbore process such as a frac process at individual hydrocarbon production zones.

Figure 1:
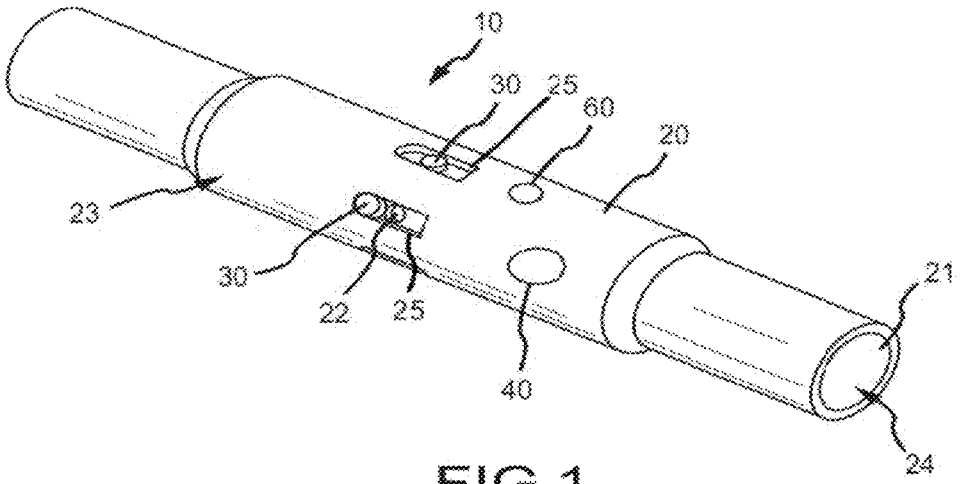
FIG. 1 is a plan view in partial perspective of a first embodiment of the downhole smart control system.

Referring now to FIG. 1, in a first embodiment, wellbore insert 10 comprises housing 20, one or more selectively movable port seals 30 disposed about housing 20 proximate port 22; electronic control module 40 disposed proximate selectively movable port seal 30; power supply 50 (FIG. 3) disposed proximate electronic control module 40 and operatively in communication with electronic control module 40; detector 80 disposed proximate housing 20 and operatively in communication with electronic control module 40; and seal mover 70 (FIG. 2) disposed proximate selectively movable port seal 30, where seal mover 70 is operatively in communication with electronic control module 40, power supply 50, and selectively movable port seal 30.

Wellbore insert 10 is dimensioned and configured to be deployed through wellbore tube 112 (FIG. 4) to control sections of well 110 (FIG. 4), e.g. ones that in the past have been producing hydrocarbons.

In typical embodiments housing 20 further comprises inner annulus 21, one or more channels 25 disposed on outer surface 23 and open to a corresponding set of port seals 30, and a set of ports 22 corresponding to the one or more channels 25. Each port 22 is dimensioned and configured to provide a fluid pathway between inner annulus 21 and outer surface 23 of housing 20 via its corresponding channel 25.

Selectively movable port seal 30 is typically disposed on outer surface 23, at least partially within housing 20, within channel 25 which is disposed on outer surface 23 and open to a corresponding port seal 30, on inner surface 24 (FIG. 3) of housing 20, or the like, or a combination thereof. Selectively movable port seal 30 typically is a seal plug dimensioned and configured to selectively occlude or open port 22, e.g. from fluid flows between inner annulus 21 and areas outside outer surface 23 such as wellbore tube 112 (FIG. 4), which can comprise a tube or pipe or the like.

Figure 2:
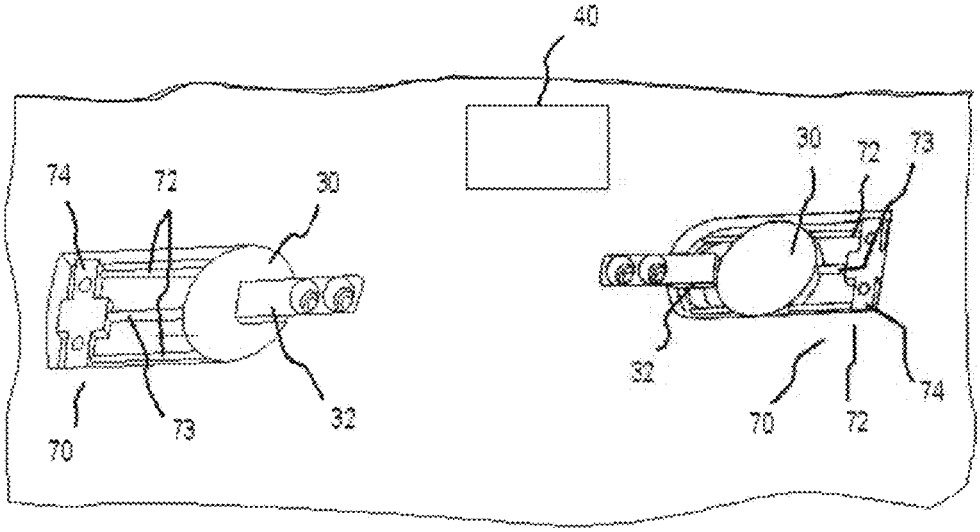
FIG. 2 is a cutaway view in partial perspective of the first embodiment of the downhole smart control system.

Referring additionally to FIG. 2, in one embodiment, selectively movable port seal 30 is slidably secured by seal retainer 32 which may further comprise one or more rails 72. In these embodiments, selectively movable port seal 30 is slidably mounted to rails 72.

Figure 3:
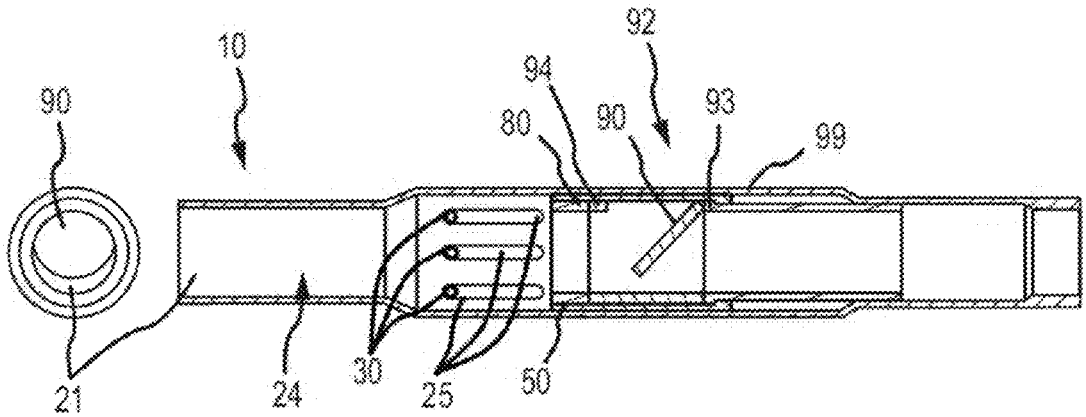
FIG. 3 is a cutaway view in partial perspective of a second embodiment of the downhole smart control system.

In one embodiment, seal mover 70 comprises screw 73 and motor 74 which is operatively in communication with screw 73 and electronic control module 40 (FIG. 3). Turning screw 73 moves selectively movable port seal 30 along rails 72 between a first position which allows fluid flow through port 22 and second position which occludes fluid flow through port 22. In a further embodiment, movement of selectively movable port seal 30 along rails 72 may be via use of solenoid 76 (not shown in the figures but configured similarly to motor 74) which is operatively in communication with screw 73 and electronic control module 40. As will be familiar to those of ordinary skill in these arts, solenoid 76 may be dimensioned and configured to move selectively movable port seal 30 between a first position which allows fluid flow in port 22 and a second position which occludes fluid flow in port 22.

Referring now additionally to FIG. 3, in a further embodiment, wellbore insert 10 further comprises one or more selectively movable plugs 90 disposed within inner annulus 21 where movable plug 90 is operatively in communication with electronic control module 40 (FIG. 3) and dimensioned and adapted to selectively occlude or open inner annulus 21. Movable plug mover 92 is operatively connected to movable plug 90. Movable plug mover 92, in typical embodiments, further comprises releasable spring 93 disposed proximate movable plug 90 and operatively in communication with movable plug 90 as well as spring release 94 disposed proximate releasable spring 93 and operatively in communication with releasable spring 93. In certain of these embodiments, releasable spring 93 is operative to release movable plug 90.

In other contemplated embodiments, movable plug mover 92 may be a mechanical mover, e.g. one comprising a piston.

Detector 80 is disposed at least partially within housing 20. Detector 80 typically comprises a sensor such as a pressure sensor, a temperature sensor, a resistivity sensor, an inductive sensor, a gamma ray sensor, a strain gauge, an accelerometer, or a radio frequency identification module, or the like, or a combination thereof. Additional sensors downhole may be deployed permanently, such as a resistivity module and gamma ray to monitor formation fluid in the well and radioactive tags deployed during a well operation such as a frac operation.

Electronic control module 40 (FIG. 2) is operatively in communication with detector 80 (FIG. 3), seal mover 70 (FIG. 2), and movable plug mover 92 (FIG. 3), and is dimensioned and configured to effect a change in either selectively movable port seal 30, movable plug 90, or both of them. Electronic control module 40 most typically comprises a microprocessor (not shown in the figures) as well as memory, both RAM and ROM, to effect the functions of electronic control module 40. Although it can be disposed in numerous places, typically electronic control module 40 is disposed totally within housing 20. In some embodiments, electronic control module 40 is responsive to input received at electronic control module 40 from detector 80 (FIG. 3) and will change the position of selectively movable port seal 30 based at least in part on data received from detector 80.

Electronic control module 40 (FIG. 2) further typically comprises a communications module (not shown in the figures) dimensioned and adapted to allow for communications from surface 102 (FIG. 4) into well 110 (FIG. 4) and from well 110 back to surface 102. The communications may comprise signals used to trigger opening and closing movable port seals 30 and/or movable plug 90 (FIG. 3) as well as to choke the flow of fluid and gas from formation 120 (FIG. 4) to the inside of wellbore insert 10. Where a plurality of movable port seals 30 exists, each may further be separately, individually controlled by an associated seal mover 70 from a corresponding plurality of seal movers 70.

In most embodiments, electronic control module 40 (FIG. 2) is selectively addressable, i.e. it has a specific and unique address as will be familiar to those of ordinary skill in the data communications arts. This address may be user selectable and/or pre-programmed into electronic control module 40. In these embodiments, changes in the position of selectively movable port seal 30 (FIG. 2) and/or movable plug 70 (FIG. 2) may be made in response to a communicated signal comprising the address of electronic control module 40.

Figure 3A:
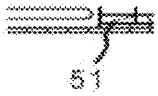
FIGS. 3*a* and 3*b* illustrate an exemplary power supply comprising a battery and a power supply comprising a power conditioner, respectively.
Figure 3B:
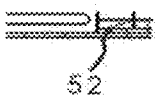

Power supply 50 (FIG. 3) may comprise battery pack 51 (FIG. 3*a*), power conditioning system 52 (FIG. 3*b*), or the like, or a combination thereof. Power supply 50 is typically disposed totally within housing 20. In certain embodiments, power supply 50 may draw its power from cable 105 (FIG. 4).

In a further embodiment, referring to FIGS. 3 and 4, a system comprising wellbore insert 10 comprises one or more packers 11 disposed above and/or below the flow control used for isolation of the inside of the tube.

Figure 4:
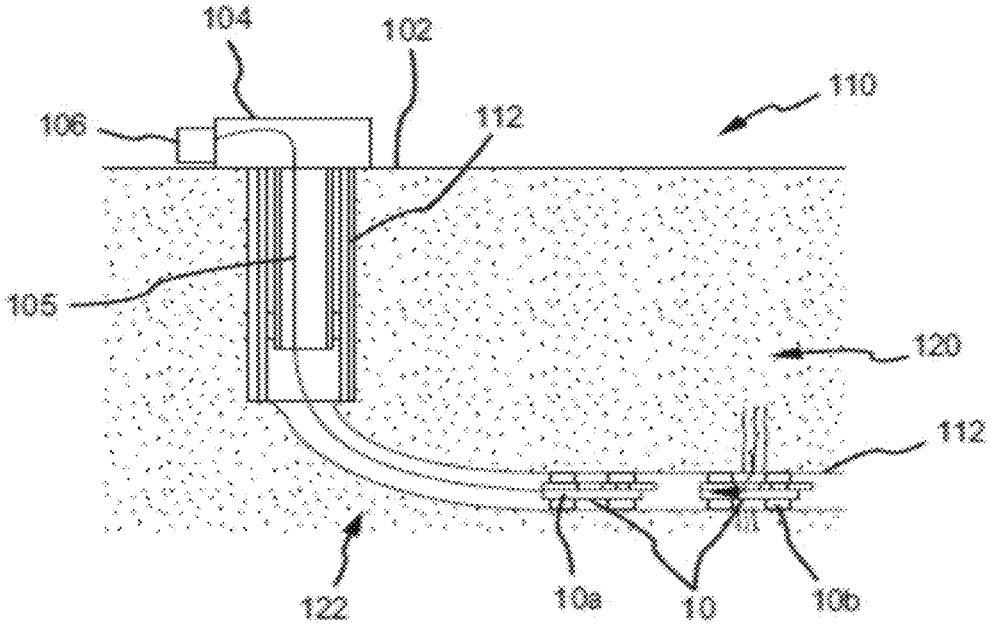
FIG. 4 is a cutaway view of an exemplary deployment of the downhole smart control system.

Referring generally to FIG. 4, in various embodiments, the claimed systems can be used for controlling wells 110, e.g. older wells, where originally no well control systems were installed. Systems using the claimed wellbore inserts 10 can be installed, e.g., through tubing 112, and can utilize tools such as packers 11 for the isolation of the inner production pipe above and below the wellbore inserts 10. The system can utilize various power supplies such as batteries 23 for power inside well 110 for control and communications. Acoustic, pressure pulses and electromagnetic waves can be used for communications in and out of well 110 for data and command transfer from downhole to surface 102 and surface 102 to downhole.

In embodiments, one or more wellbore inserts 10 can be deployed in deepwater applications where the full inner bore of wellbore tube 112 is required for production of hydrocarbons or fluid injection in wells 110. In these embodiments, wellbore insert 10 may be larger than otherwise used for non-deepwater applications. In these embodiments, one or more movable port seals 30 may be removed from wellbore insert 10 for use in a deepwater well to allow control of the flow of hydrocarbons where a full bore inside diameter capability of the production pipe is required and where no moving modules inside the pipe is acceptable for higher reliability.

Wellbore inserts 10 can be deployed anywhere in well 110 including being deployed in laterals of wells 110. The ability to have short hop power and communications in conjunction with wellbore inserts 10 aids in allowing for full control and monitoring of the laterals for increase production of hydrocarbons.

In the operation of a preferred embodiment, one or more ports 22 (FIG. 1) are drilled in housing 20 (FIG. 1) and accessible via a corresponding set of channels 25 (FIG. 1) and movable port seal 30 (FIG. 1) is disposed at least partially within channel 25 (FIG. 1) and operatively attached to motor 74 (FIG. 2) disposed about housing 20. Movement of an operative part of motor 74 causes movable port seal 30 to move, e.g. slide along rails 72 (FIG. 2), and selectively open or close port 22. In a preferred embodiment, when movable port seal 30 closes port 22 it seals port 22 as well.

In further embodiments, movable plug 90 (FIG. 3) is also present. Movable plug 90 may be selectively moved from a first to a second position inside housing 20 to selectively open or close inner annulus 21 (FIG. 2) to fluid flow such as might be needed for, e.g., frac work. Movable plug 90 seals well 110 (FIG. 4). Movable port seal 30 (FIG. 2), attached to motor 74 (FIG. 2), may then open, allowing the frac fluid to go from inner annulus 21 into formation 120 (FIG. 4). This allows deployment of wellbore insert 10 (FIG. 1) through wellbore tube 112 (FIG. 4) to control fluid flow such as from the existing perforated zones that were producing without control. Using wellbore insert 10 can allow, e.g., shutting off any zone that produces water.

The same flow control can be used in deepwater for deployment in laterals 122 (FIG. 4). However, in a currently contemplated embodiment wellbore insert 10 for such environments will be larger than a non-deepwater, through tubing one.

In a preferred embodiment, movable plug 90 (FIG. 3) moves from a first position within inner annulus 21 (FIG. 2), and plugs wellbore tube 112 (FIG. 4) by moving to a second position within inner annulus 21 to impede fluid flow within wellbore tube 112. Once movable plug 90 is released and plugs inner annulus 21, high pressure is created on movable plug 90 using fluid introduced from upstream location 104 (FIG. 4), e.g. a pump located at surface 102 (FIG. 4). This high pressure fluid is detected by one or more detectors 80 (FIG. 3) which provide information to electronic control module 40 (FIG. 2) and electronic control module 40 may use that information in deciding whether or not to open movable port seal 30 (FIG. 2). Opening movable port seal 30 typically allows fluid flow between inner annulus 21 and formation 120 (FIG. 4).

Electronic control module 40 (FIG. 2), which typically comprises a microprocessor and associated memory, will monitor data acquired downhole such as pressure data and may further await a command signal which may comprise pattern of high and low pulses such as pressure pulses created at surface 102 by control system 106 (FIG. 4). Once electronic control module 40 detects and verifies the proper pattern it will cause operation of movable plug mover 92 (FIG. 3) (e.g., a motor or solenoid) to release releasable spring 93 (FIG. 3), thereby releasing movable plug 90 (FIG. 3). Movable plug 90 moves from its first position to its second position, thereby plugging wellbore tube 112 by closing inner annulus 21 (2) to further fluid flow.

Once wellbore tube 112 is plugged, high pressure is placed on movable plug 90 (FIG. 3) such as by introducing a fluid under pressure from an upstream position, e.g. surface 102. Once the high pressure is detected downhole, electronic control module 40 2) instructs seal mover 70 (FIG. 2) to move one or more selectively movable port seals 30 (FIG. 2) in housing 20 (FIG. 2).

Wellbore insert 10 (FIG. 3) can be used for frac operations, through tubing zone production operations, intelligent well applications, and the like, or combinations thereof. By way of example and not limitation, for frac operations, the frac work starts where surface fluid is pumped through wellbore insert 10 (FIG. 4) deployed downhole into formation 120 (FIG. 4). Typical configurations will have multiple wellbore inserts 10, e.g. wellbore inserts 10*a* and 10*b*, deployed in sequence in wellbore tube 112 (FIG. 4) at offsets from one another within wellbore tube 112. For these configurations, once the frac is completed, a second set of pressure sequences is generated from surface 102 (FIG. 4) to move a further wellbore insert 10, e.g. an adjacent one such as 10*b*, in a further part of wellbore tube 112. This second pressure sequence may differ in its high and low pulse sequences from the prior pressure sequence.

Upon the completion of all frac operations, a control system such as control system 106 (FIG. 4) sends a command signal which may comprise a third pressure pulse sequence. Upon detection and verification of this command signal, electronic control module 40 of a predetermined movable insert 10, e.g. 10*a* (FIG. 4) which is closest to surface 102, instructs movable plug mover 92 (FIG. 3) to move movable plug 90 (FIG. 3) back to its first position, e.g. its open position within inner annulus 21 (FIG. 3), to allow for fluid production.

In certain embodiments, when movable plug 90 (FIG. 3) is released, upstream fluid, e.g. fluid from surface 102 (FIG. 4), is allowed to flow in wellbore tube 112 to the next wellbore insert 10 in well 110 (FIG. 4), e.g. from wellbore insert 10*a* (FIG. 4) to wellbore insert 10*b* (FIG. 4). In certain embodiments, detection of higher pressure or pressure pulses trigger electronic control module 40 (FIG. 2) to release spring 93 (FIG. 3) to move movable plug 90 within wellbore insert 10.

This sequencing can be repeated until all moveable plugs 90 (FIG. 3) within wellbore inserts 10 (FIG. 3) deployed in wellbore tube 112 have been released and the entire length of wellbore pipe 112 is free to allow fluids such as hydrocarbons to flow within wellbore tube 112.

The foregoing disclosure and description of the inventions are illustrative and explanatory. Various changes in the size, shape, and materials, as well as in the details of the illustrative construction and/or an illustrative method may be made without departing from the spirit of the invention.

What is claimed is:

1. A wellbore insert, comprising:

a. a housing, the housing further comprising:

i. an inner annulus;

ii. a channel extending a predetermined distance along an outer surface of the housing without intruding into the inner annulus; and iii. a port in fluid communication with the channel and the inner annulus, the port defining a fluid pathway between the inner annulus of the housing and an outer surface of the housing through the channel;

b. a selectively movable port seal slidably disposed at least partially within the channel proximate the port, the selectively movable port seal dimensioned and configured to repeatedly selectively occlude or open the port;

c. an electronic control module disposed proximate the selectively movable port seal, the electronic control module dimensioned and configured to effect a change in the selectively movable port seal;

d. a detector disposed proximate the housing and operatively in communication with the electronic control module;

e. a seal mover disposed proximate and operatively connected to the selectively movable port seal; and f. a power supply disposed proximate the electronic control module and operatively in communication with the electronic control module and the seal mover, the seal mover operatively in communication with the electronic control module and the power supply.

2. The wellbore insert of claim 1, further comprising:

a. a selectively movable plug disposed within the inner annulus, the selectively movable plug operatively in communication with the electronic control module, the movable plug dimensioned and adapted to repeatedly selectively occlude or open the inner annulus; and b. a movable plug mover operatively connected to the movable plug and operatively in communication with the electronic control module and the power supply;

c. wherein the electronic control module is further dimensioned and configured to effect a change in the selectively movable plug.

3. The wellbore insert of claim 2, wherein the movable plug mover further comprises:

a. a releasable spring disposed proximate the movable plug and operatively in communication with the movable plug; and b. a spring release disposed proximate the spring and operatively in communication with the releasable spring.

4. The wellbore insert of claim 2, wherein the electronic control module further comprises a communications module dimensioned and adapted to allow for communications from the surface into the well and from the well to the surface to repeatedly selectively open and close the moveable plug to choke the flow of fluid and gas from a formation into which the well has been inserted to the inside of the wellbore insert.

5. The wellbore insert of claim 1, wherein the selectively movable port seal comprises a seal plug.

6. The wellbore insert of claim 1, wherein the selectively movable port seal further comprises a portion disposed at least partially within the housing, on the outer surface of the housing, or within the inner annulus of the housing.

7. The wellbore insert of claim 1, further comprising:

a. a seal retainer disposed proximate the channel, the seal retainer comprising a rail to which the selectively movable port seal is slidably mounted;

b. wherein the seal mover comprises:

i. a screw operative to move the selectively movable port seal along the rail between a first position which allows fluid flow in the port and a second position which occludes fluid flow in the port; and ii. a motor operatively in communication with the screw and the electronic control module.

8. The wellbore insert of claim 1, further comprising:

a. a seal retainer disposed proximate the channel, the seal retainer comprising a rail to which the selectively movable port seal is slidably mounted;

b. wherein the seal mover comprises a solenoid operatively in communication with the selectively movable port seal and the electronic control module, the solenoid dimensioned and configured to move the selectively movable port seal between a first position which allows fluid flow in the port and a second position which occludes fluid flow in the port.

9. The wellbore insert of claim 1, wherein the electronic control module is disposed totally within the housing.

10. The wellbore insert of claim 1, wherein the electronic control module is dimensioned and configured to effect a change in the selectively movable port seal based at least in part on input received at the electronic control module from the detector.

11. The wellbore insert of claim 1, wherein the electronic control module is selectively addressable and dimensioned and configured to effect a change in the selectively movable port seal in response to a communicated signal comprising the electronic control module's address.

12. The wellbore insert of claim 1, wherein the power supply further comprises at least one of a battery pack or a power conditioning system.

13. The wellbore insert of claim 12, wherein the battery pack is disposed totally within the housing.

14. The wellbore insert of claim 1, wherein the detector is disposed at least partially within the housing.

15. The wellbore insert of claim 1, wherein the detector comprises a sensor.

16. The wellbore insert of claim 15, wherein the sensor comprises at least one of a pressure sensor, a temperature sensor, a resistivity sensor, an inductive sensor, a gamma ray sensor, a strain gauge, an accelerometer, or a radio frequency identification module.

17. The wellbore insert of claim 1, wherein the wellbore insert is dimensioned and configured to be deployed through a wellbore tube to control sections of the well.

18. The wellbore insert of claim 1, further comprising a set of packers disposed on opposite ends of the wellbore insert and dimensioned and adapted for isolation of fluid inside of a wellbore.

19. A downhole smart control system, comprising:

a. a plurality of wellbore inserts, each wellbore insert comprising:

i. a housing, the housing further comprising:

1. an inner annulus;
2. a channel extending a predetermined distance along an outer surface of the housing without intruding into the inner annulus; and
3. a port in fluid communication with the channel and the inner annulus and dimensioned and configured to provide a fluid pathway between the inner annulus of the housing and an outer surface of the housing through the channel;

ii. a selectively movable port seal slidably disposed at least partially within the channel proximate the port, the selectively movable port seal dimensioned and configured to repeatedly selectively occlude or open the port;

iii. a seal mover disposed proximate the selectively movable port seal, the seal mover operatively connected to the movable port seal;

iv. a selectively movable plug disposed within the inner annulus, the movable plug dimensioned and adapted to repeatedly selectively occlude or open the inner annulus;

v. a plug mover disposed proximate the selectively movable plug, the plug mover operatively connected to the movable plug;

vi. a detector disposed proximate the housing;

vii. an individually addressable electronic control module disposed proximate the selectively movable port seal, the electronic control module operatively in communication with the detector, the seal mover, and the plug mover, the electronic control module dimensioned and configured to selectively effect a change in the seal mover and the plug mover upon receipt and verification of a control command comprising the individual address of the electronic control module; and viii. a power supply disposed proximate the electronic control module and operatively in communication with at least one of the electronic control module, the seal mover, and the plug mover; and b. a control system, operatively in communication with a predetermined set of the individually addressable electronic control modules.

* * * * *